US007216890B2

(12) United States Patent
Walker et al.

(10) Patent No.: US 7,216,890 B2
(45) Date of Patent: May 15, 2007

(54) SKI BINDING

(75) Inventors: Ben Walker, Orem, UT (US); Mark Santurbane, Salt Lake City, UT (US); David Narajowski, Heber City, UT (US); David Mellon, Park City, UT (US); Thomas Laakso, Park City, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 105 days.

(21) Appl. No.: 10/881,651

(22) Filed: Jun. 30, 2004

(65) Prior Publication Data

US 2006/0001240 A1 Jan. 5, 2006

(51) Int. Cl.
*A63C 9/086* (2006.01)

(52) U.S. Cl. ..... 280/619; 280/612; 280/633; 280/634; 280/635

(58) Field of Classification Search ..... 280/619, 280/613, 615, 618, 620, 621, 622, 633, 634, 280/611, 635
See application file for complete search history.

(56) References Cited

U.S. PATENT DOCUMENTS

| | | | | | |
|---|---|---|---|---|---|
| 2,276,252 | A | * | 3/1942 | Leif et al. | 280/621 |
| 2,777,705 | A | * | 1/1957 | Goodman | 280/619 |
| 3,261,615 | A | * | 7/1966 | Beyl | 280/621 |
| 3,901,523 | A | * | 8/1975 | Burger | 280/614 |
| 4,273,355 | A | * | 6/1981 | Storandt | 280/614 |
| 4,887,833 | A | * | 12/1989 | Bailey | 280/615 |
| 5,106,118 | A | | 4/1992 | Frey | 280/636 |
| 5,499,838 | A | * | 3/1996 | Hauglin et al. | 280/615 |
| 5,518,264 | A | * | 5/1996 | Broughton | 280/615 |
| 5,669,622 | A | * | 9/1997 | Miller | 280/615 |
| 5,823,563 | A | * | 10/1998 | Dubuque | 280/615 |
| 5,893,576 | A | * | 4/1999 | Hauglin | 280/621 |
| 5,897,127 | A | | 4/1999 | Hauglin | 280/615 |
| 5,947,507 | A | * | 9/1999 | Quintana et al. | 280/615 |
| 5,957,478 | A | | 9/1999 | Vigny | 280/615 |
| D425,162 | S | * | 5/2000 | Hauglin | D21/773 |
| 6,092,830 | A | | 7/2000 | Wheeler | 280/624 |
| 6,105,994 | A | | 8/2000 | Parris et al. | 280/615 |
| 6,202,326 | B1 | | 3/2001 | Hauglin | 36/117.2 |
| 6,234,514 | B1 | * | 5/2001 | Dubuque | 280/619 |
| 6,299,193 | B1 | | 10/2001 | Parris et al. | 280/614 |
| 6,308,979 | B1 | * | 10/2001 | Ludlow | 280/615 |
| 6,322,095 | B1 | | 11/2001 | Wheeler | 280/613 |
| 6,371,506 | B1 | * | 4/2002 | DeNicola | 280/607 |
| 6,390,493 | B1 | * | 5/2002 | Hauglin | 280/615 |
| 6,409,204 | B1 | * | 6/2002 | Ayliffe | 280/613 |
| 6,467,796 | B1 | * | 10/2002 | Weltman et al. | 280/615 |
| 6,585,248 | B2 | | 7/2003 | Baud | 269/296 |
| 6,623,027 | B1 | | 9/2003 | Wheeler | 280/623 |
| 6,685,213 | B2 | | 2/2004 | Hauglin | 280/624 |
| 2003/0006585 | A1 | * | 1/2003 | Ayliffe | 280/615 |
| 2005/0212263 | A1 | * | 9/2005 | Steffen et al. | 280/619 |

* cited by examiner

*Primary Examiner*—J Allen Shriver
(74) *Attorney, Agent, or Firm*—Trent H. Baker; Baker & Associates PLLC

(57) ABSTRACT

The present invention relates to an improved telemark ski binding. More particularly, the present invention relates to a dual front cable under-foot telemark binding. The two front cables attach to a linkage point within the toe receiving portion. The front cables are also designed to be easily replaceable by a consumer thereby extending the overall lifespan of the binding. In addition, the coupling between the two front cables and the resistance mechanism cartridges includes a unique rotational and lateral chalking mechanism that prevents inadvertent adjustment.

28 Claims, 6 Drawing Sheets

SKI BINDING

BACKGROUND OF THE INVENTION

1. Field of the Invention

The present invention relates to ski bindings. More particularly, the present invention relates to a dual front cable binding.

2. Background and Related Art

Telemark skiing refers to a type of skiing in which the ball of a skier's foot is bound to the ski but the heel is free to pivot. This type of connection system between the skier's foot and the ski is also used in traditional and skate style cross-country skiing. In addition, certain types of backcountry snowboards, known as splitboards, utilize a similar system in which the boarder's heel is able to pivot when the board is in its split/ski mode. All of these snow-sport activities require advanced binding systems that connect the skier/boarder to the ski/board but allow the heel to move. If a particular binding does not allow the user's heel to freely pivot, it will impede their ability to ascend a snow slope.

Various characteristics have become increasingly important in the design of ski bindings. These features include the long term durability and the overall performance of a binding. The long term durability refers to the overall life span of a binding. Most bindings include some form of straps, cables, or plates which secure a user onto a ski/board. Over time these straps, cables, or plates will often wear down and possibly break causing the binding to fail. If the straps or cables are not easily interchangeable, the binding's life span will be dictated by the life span of the straps or cables thereby reducing the overall value of the binding. However, if the straps or cables are easily replaceable, the life span of the binding can be significantly extended. Therefore, it is desirable for a binding to include replaceable straps or cables to extend the overall life span of the binding.

The overall performance of a binding is a measurement of the binding's ability to function under a wide variety of circumstance. For example, a telemark binding's ability to maintain tension is a factor in the bindings overall performance. The performance of a binding is also affected by the ability of a binding to reliably secure a user's foot in a wide variety of circumstances. For example, if a binding fails (releases a user's foot from a ski/board) in an undesirable situation, it is thought to be unreliable. Therefore, it is also desirable for a binding to maximize its overall performance.

There is a need in the industry for a binding that is capable of maximizing performance and life span by enabling the cables or straps to be replaceable.

SUMMARY OF THE INVENTION

The present invention relates to an improved telemark ski binding. More particularly, the present invention relates to a dual front cable under-foot telemark binding. The two front cables attach to a linkage point within the toe-receiving portion. The front cables are also designed to be easily replaceable by a consumer thereby extending the overall lifespan of the binding. In addition, the coupling between the two front cables and the resistance mechanism cartridges includes a unique rotational and lateral chocking mechanism that prevents inadvertent adjustment.

In one embodiment, the present invention relates to a unique telemark ski binding that allows for replaceable dual front cables on an under-foot binding. Under-foot bindings provide significant performance advantages over other types of telemark bindings but have traditionally suffered from reliability and misalignment problems. The under-foot binding of the present invention maintains the advantages of an under-foot binding while eliminating the problems suffered by other under-foot bindings. The dual front cables are inserted through a resistance mechanism cartridge and then releasably coupled to the front of the binding. The rear end of the cable is chocked both axially and rotationally within the cartridge. The unique rotational chocking further prevents the resistance mechanism cartridge from inadvertently loosening or releasing during use. The dual front cable design also prevents the binding from becoming misaligned and inadvertently releasing as a result.

While the methods and processes of the present invention have proven to be particularly useful in the area of ski bindings, those skilled in the art can appreciate that the methods and processes can be used in a variety of different applications and in a variety of different areas of manufacture.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to an improved telemark ski binding. More particularly, the present invention relates to a dual front cable under-foot telemark binding. The two front cables are releasably secured to a linkage point within the toe-receiving portion. The front cables are also designed to be easily replaceable by a consumer thereby extending the overall lifespan of the binding. In addition, the coupling between the two front cables and the resistance mechanism cartridges includes a unique rotational and lateral chocking mechanism that prevents inadvertent adjustment while allowing for the convenient replacement of the cables. While embodiments of the present invention are directed to ski binding technology, it will be appreciated that the teaching of the present invention are also applicable to other areas.

Figure 1:
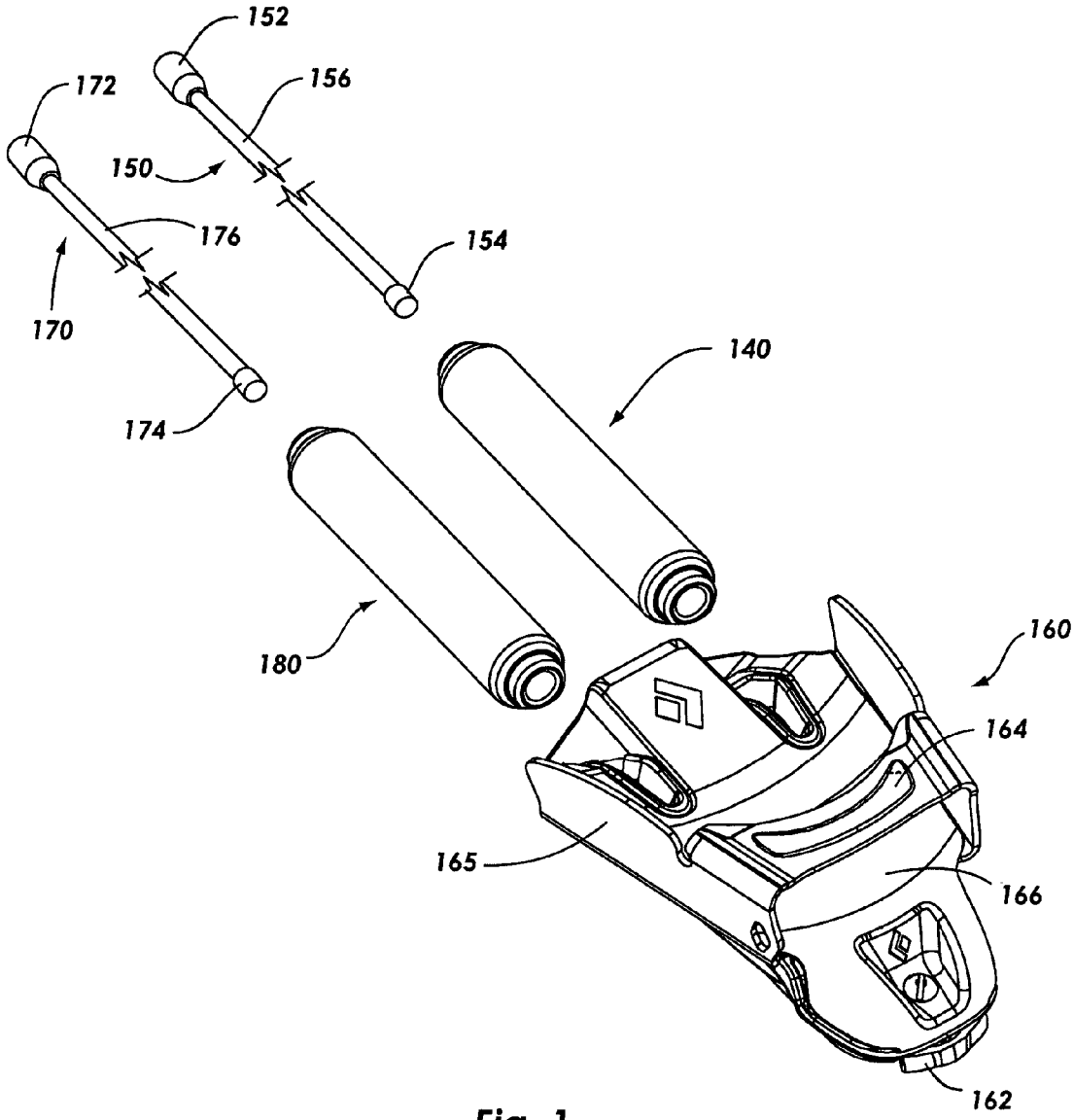
FIG. 1 illustrates an exploded view of the front portion of one embodiment of a binding in accordance with the present invention.

Reference is initially made to FIG. 1, which illustrates an exploded view of the front portion of a ski binding in accordance with one embodiment of the present invention. The exploded front portion includes a toe-receiving portion 160, a linkage 162, a first and second cartridge 140, 180, and a first and second cable 150, 170. The toe-receiving portion 160 is designed to conform to the general shape of the front portion of a ski boot. The illustrated embodiment of a toe-receiving portion includes a bottom surface 166, two side surfaces 165, and a top retaining surface 164. The various surfaces 166, 165, 164 are designed to receive the toe portion of a ski boot and constrain its movement. The entire toe-receiving portion 160 is attached to a ski below the bottom surface 166. The term "ski" is used broadly to include any snow travel device including but not limited to a telemark ski, a cross-country ski, an alpine ski, a split-board, a sled ski track, etc. Various other surface configurations may be used on the toe-receiving portion 160 and remain consistent with the present invention.

Figure 2:
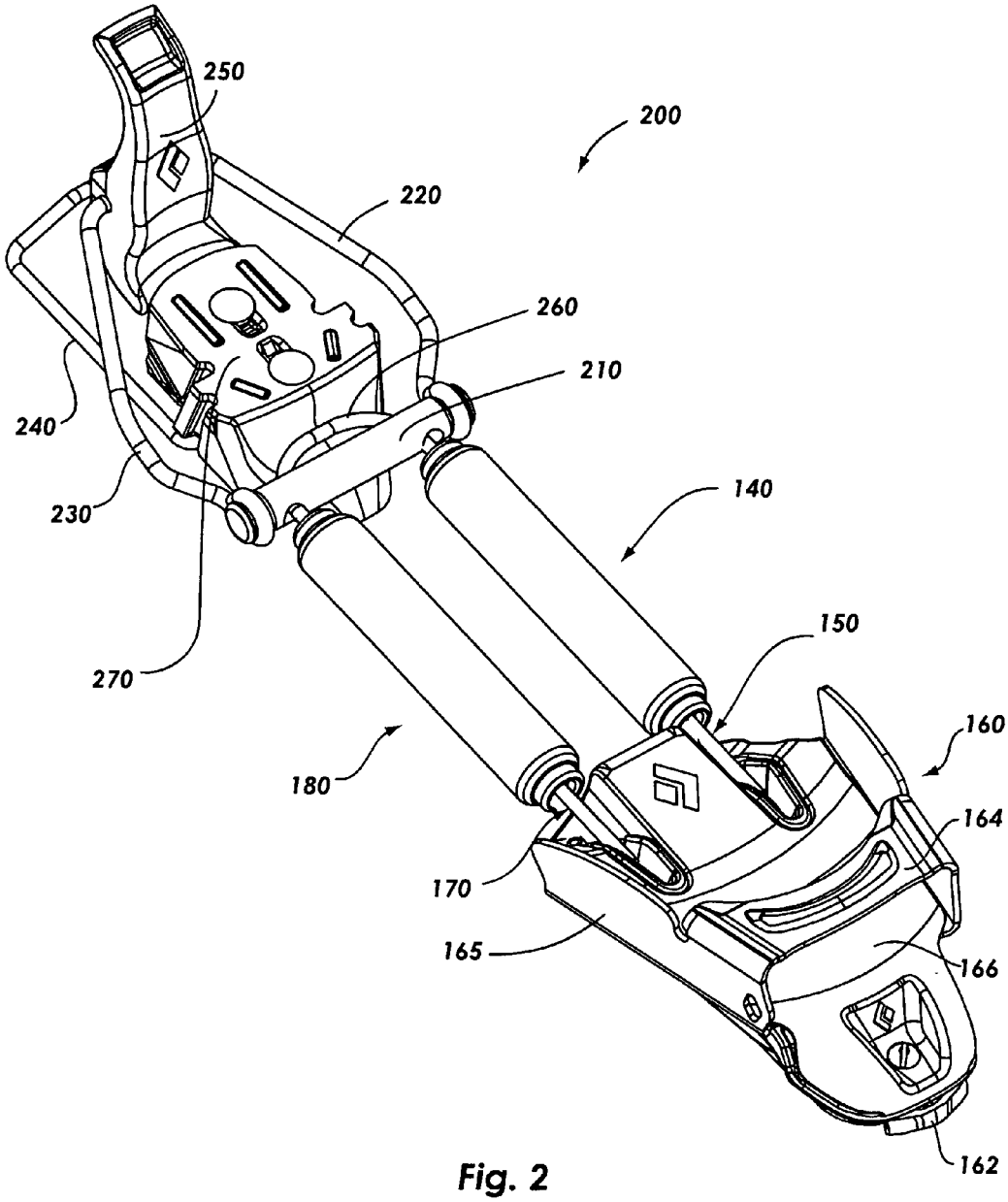
FIG. 2 illustrates a perspective view of an assembled binding in accordance with the present invention.

The linkage 162 is a cable end retaining device that is disposed at the front portion of the toe-receiving portion 160 as illustrated. The linkage 162 is fitted below the bottom surface 166 such that the two cables 150, 170 can be routed below the bottom surface 166 and coupled to the linkage 162 as shown in FIG. 2. Other under-foot telemark bindings use a single cable that is simply wrapped around the front of the toe receiving portion. The linkage 162 includes two substantially hollow recesses that allow the cables to be axially chocked within the linkage 162. Once chocked within the linkage 162, the cable ends are prevented from axially moving away from the linkage 162. The linkage 162 is fixably secured to the toe-receiving portion 160. The illustrated dual-cable and linkage system overcomes problems with prior art under-foot bindings and prevents the cables from slipping out of alignment.

Figure 5:
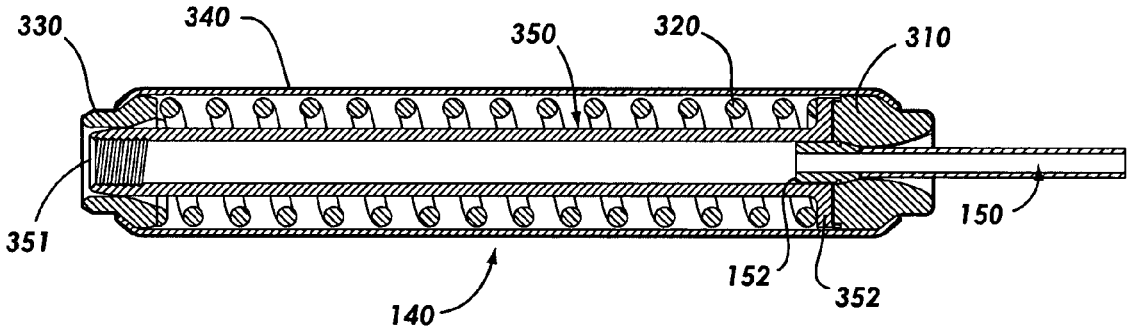
FIG. 5 illustrates a cross-sectional view of a cartridge for use with a binding in accordance with the present invention.
Figure 6:
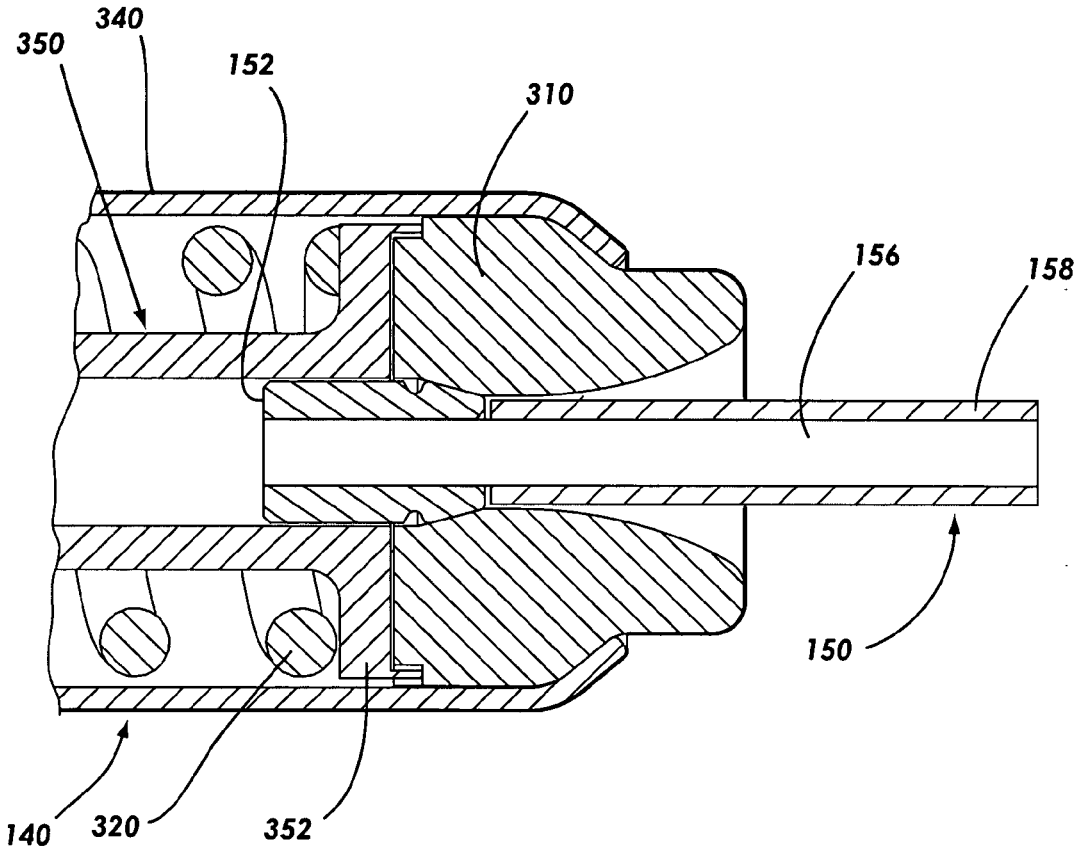
FIG. 6 illustrates a detailed cross-sectional view of the front portion of the cartridge illustrated in FIG. 5.

The cartridges 140, 180 include resistance mechanisms and cable attachment mechanisms which are described in more detail with reference to FIGS. 5 and 6. The cartridges 140, 180 are designed to allow the cables 150, 170 to extend through one end and be retained or chocked internally near the other end. This drop-in style attachment system allows the cables 150, 170 to be easily replaceable while minimizing the size of the connection between the cartridges 140, 180 and the cables 150, 170. The cables 150, 170 include a linkage end 154, 174 and a cartridge end 152, 172. The linkage ends 154, 174 are extended through the cartridges 140, 180, below the bottom surface 166 of the toe receiving portion 160, and coupled to the linkage 162 in the manner described above. The cartridge ends 152, 172 are rotationally and axially chocked within the cartridge as shown in FIGS. 5 and 6.

Reference is next made to FIG. 2, which illustrates a perspective view of an assembled binding in accordance with the present invention, designated generally at 200. The cartridges 140, 180 are also coupled to a rear cable or wire 260 in order to secure the cartridges to the heel attachment mechanism. The heel attachment mechanism includes a heel throw 250, a first rigid connector 220, and a second rigid connector 230. The first and second rigid connector 220, 230 are coupled to the rear cable or wire 260 via a connection member 210. The heel connection system 250, 220, 230 is designed to snap over a horizontal protrusion on the rear portion of a ski boot while allowing the cables 150, 170 and the cartridges 140, 180 to remain below the ski boot. The heel throw 250 creates a mechanical lever arm allowing a user to extend the resistance mechanisms within the cartridges and snap the heel connection system 250, 220, 230 around the ski boot.

The illustrated binding 200 also includes a heel plate 270 fixably secured to the ski. The heel plate is not attached to the heel connection system 250, 220, 230 enabling a user's heel to pivot freely when coupled to the binding. The heel plate 270 prevents a user's heel from dropping below the level of the user's toe. In the illustrated embodiment, the heel plate 270 is approximately the height of the lower surface 166 of the toe retaining portion 160. The heel plate 270 may also include one or more risers 240. The risers 240 can be raised during climbing to minimize the effort required to climb a particular hill.

Figure 3:
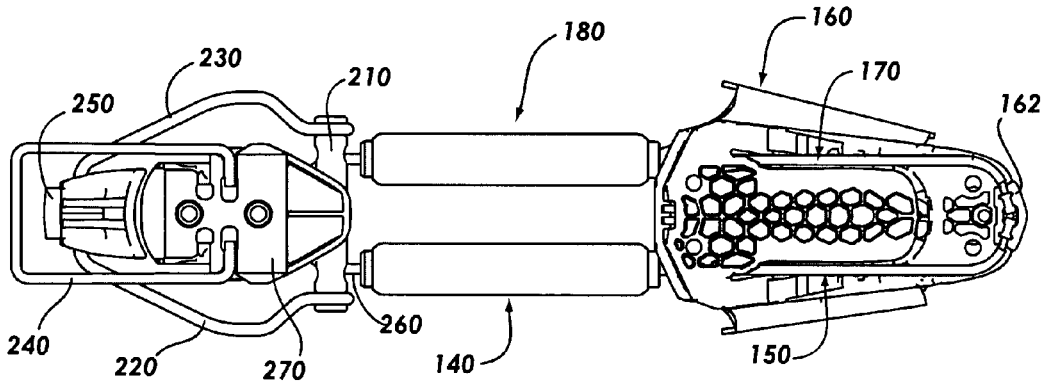
FIG. 3 illustrates a bottom view of the binding illustrated in FIG. 2.

Reference is next made to FIG. 3, which illustrates a bottom view of the binding illustrated in FIG. 2. This view illustrates the routing of the cables 150, 170 between the linkage 162 and the cartridges 140, 180. The cables 150, 170 are coupled to the linkage 162 in a chocking configuration and then routed below a substantial portion of the toe receiving portion 160, as shown. The cables 150, 170 are routed through individual recesses in the toe receiving portion and then coupled to the cartridges 140, 180, as shown. The connection mechanism between the cables 150, 170 and the cartridges 140, 180 is a rotational and axial chocking system which will be described in more detail with reference to FIGS. 5 and 6. The cartridges 140, 180 are also coupled to a rear cable or wire 260. The rear cable or wire 260 is fitted through a connection member 210 which is coupled to the heel connection system 250, 220, 230 described above. The toe plate 270 and riser 240 are not connected to the remainder of the binding 200 in any manner.

Figure 4:
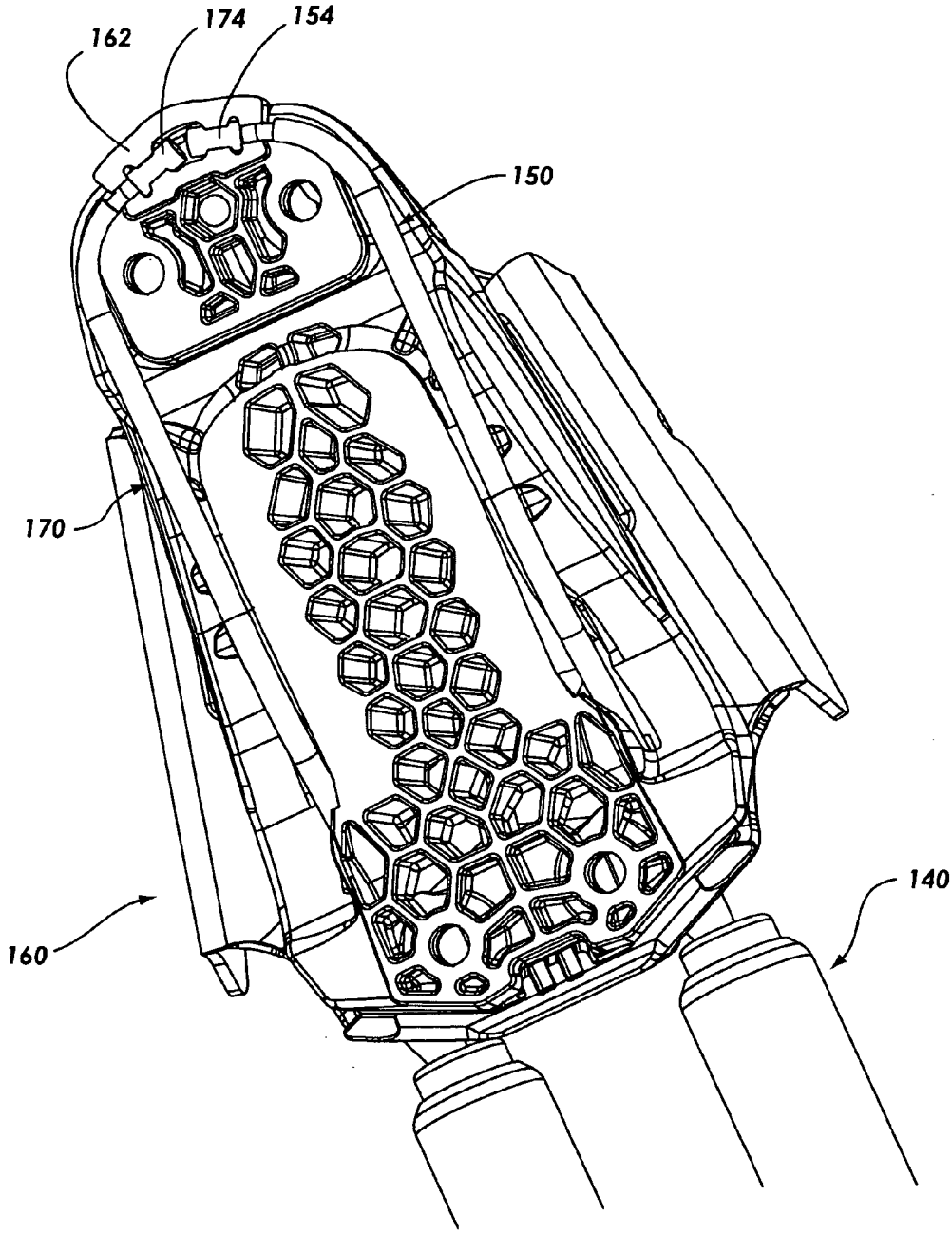
FIG. 4 illustrates a detailed view of the front bottom portion of the binding illustrated in FIG. 2.

Reference is next made to FIG. 4, which illustrates a detailed view of the front bottom portion of the binding illustrated in FIG. 2. The illustrated embodiment of the chocking connection system between the linkage ends 154, 174 of the cables 150, 170 and the linkage 162 is shown. The linkage ends 154, 174 are slotted into the linkage and coupled via an axial wedge, as shown. Alternative connection systems between the cables 150, 170 and the linkage 162 could also be implemented and remain consistent with the present invention.

Reference is next made to FIG. 5, which illustrates a cross-sectional view of a cartridge for use with a binding in accordance with the present invention. The cartridge 140 includes an entrance connector 330, an outer housing 340, an internal flared tube 350, a resistance mechanism 320, and an exit connector 310. The entrance connector 330 provides a mechanism for attaching the cartridge 140 to a cable or wire. The most common form of entrance connector 330 is a female threaded receiver that is capable of connecting to a male threaded connector disposed on the cable or wire. Other types of entrance connectors 330 may be utilized and remain consistent with the present invention. The entrance connector 330, in the present invention, must provide a channel through which the cable 150 can be dropped through. Therefore, the channel must be large enough to allow both the linkage end (not shown) and the cartridge end 152 of the cable 150 to pass through. The illustrated embodiment of the entrance connector 330 includes a female threaded receiver disposed within receiving end 351 of the flared tube 350.

The outer housing 340 is composed of a rigid material including but not limited to metal or plastic and is designed to protect the remainder of the cartridge from impacts and snow. It is desirable to minimize impact forces on the resistance mechanism 320 and the connectors 330, 310 to maintain reliability of the cartridge 140. The term "resistance mechanism" is used broadly to include but not be limited to a spring, an elastomer member, etc. The outer housing 340 may include various identification marks indicating the type of connection system and the strength of the resistance mechanism 320.

The flared tube 350 is shaped like an elongated cylinder or tube with a receiving end 351 and a flared end 352. The receiving end 351 is disposed within the entrance connector 330 and the flared end 352 is disposed such that it abuts against the exit connector 310, as shown. The resistance mechanism 320 biases the flared end 352 of the flared tube 350 against the exit connector 310. The flared end 352 also includes some form of releasable connection with the outer housing 340 and/or the exit connector 310. The releasable connector includes but is not limited to a friction connector, a key connector, etc. The receiving end 351 is configured to be coupled to a cable or wire via a threaded connection system. Therefore, when the cartridge is under load, the resistance mechanism 320 is compressed by the flared end 352 of the flared tube 350 thereby disengaging the connection between the flared end 352 and the outer housing 340 and/or the exit connector 310. If the entrance connector 330 utilizes a threaded connector, it is necessary to disengage the ability to release the entrance connector 330 when the cartridge is under load to prevent inadvertent adjustment or release during use.

The exit connector 310 includes a unique tapering and connection system for coupling the cartridge end 152 of the cable 150 to the cartridge 140. After the cable 150 is dropped through the cartridge, the cartridge end 152 is chocked axially within the taper of the exit connector 310, as shown. In addition to axially chocking the cartridge end 152 of the cable 150 within the exit connector, the exit connector also rotationally chocks the cartridge end 152 of the cable 150 thereby preventing it from rotating within the cartridge. The system for creating rotational chocking of the cable 150 includes but is not limited to frictional chocking, key-socket chocking, etc. If the entrance connector 330 is a threaded connector, the rotational chocking of the cable 150 at the exit connector 310, further prevents the entrance pulley from inadvertently loosening or releasing.

Reference is next made to FIG. 6, which illustrates a detailed cross-sectional view of the front portion of the cartridge illustrated in FIG. 5. This figure more clearly illustrates the axial chocking of the cartridge end 152 of the cable 150 within the exit connector 310. In addition to the cartridge end 152, the cable 150 further includes a wire core 156, and an exterior coating 158.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A ski binding comprising:

a toe portion compatible with a front portion of a ski boot, wherein the toe portion is coupled to a ski;

a coupling system configured to releasably secure the ski boot to the toe portion, wherein the coupling system includes:

a heel attachment mechanism;

at least two cables coupled to the toe portion and configured to extend below the ski boot;

at least one resistance mechanism which includes two resistance mechanism cartridges configured to be disposed under the ski boot and coupled to the at least two cables.

2. The ski binding of claim 1, wherein the toe portion includes a lower surface, two side surfaces, and an upper surface.

3. The ski binding of claim 1, wherein the toe portion includes a linkage configured to releasably secure the at least two cables at the toe portion.

4. The ski binding of claim 3, wherein the coupling between the linkage and the at least two cables includes an axial wedge.

5. The ski binding of claim 1, wherein the toe portion includes at least two recesses for the at least two cables to extend through.

6. The ski binding of claim 1, wherein the coupling system further includes at least one resistance mechanism.

7. The ski binding of claim 1, wherein the heel attachment mechanism further includes a heel throw and two rigid wires.

8. The ski binding of claim 1, wherein the ski binding further includes a heel plate configured to prevent a heel portion of the ski boot from dropping below a lower surface of the toe portion.

9. The ski binding of claim 1, wherein the coupling system further includes two resistance mechanism cartridges, and wherein the at least two cables include a linkage end and a cartridge end, and wherein the linkage end is configured to be inserted through the resistance mechanism cartridge, and the cartridge end is configured to axially and rotationally chock within the cartridge.

10. The ski binding of claim 9, wherein the linkage end is smaller than the cartridge end of the at least two cables.

11. A ski binding comprising:

a toe receiving portion including an upper and lower retaining surface, wherein the toe receiving portion includes a linkage;

at least two cables extending below a portion of the lower retaining surface and coupling to the linkage;

at least one resistance mechanism coupled to the at least two cables and disposed below a portion of the lower retaining surface; and a heel attachment mechanism coupled to the at least one resistance mechanism two cables.

12. The ski binding of claim 11, wherein the upper and lower retaining surfaces of the toe receiving portion are configured to constrain the movement of a ski boot.

13. The ski binding of claim 11, wherein the toe receiving portion is coupled to a ski.

14. The ski binding of claim 11, wherein the linkage is disposed below the lower surface.

15. The ski binding of claim 11, wherein the at least two cables are coupled to the linkage via an axial chocking system.

16. The ski binding of claim 11, wherein the ski binding further includes at least one resistance mechanism disposed between the at least two cables and the heel attachment mechanism.

17. The ski binding of claim 11, wherein the at least one resistance mechanism includes two resistance mechanism cartridges disposed between the at least two cables and the heel attachment mechanism.

18. The ski binding of claim 11, wherein the heel attachment mechanism further includes a heel throw and two rigid wires.

19. The ski binding of claim 11, wherein the ski binding further includes a heel plate configured to prevent a heel portion of the ski boot from dropping below a lower surface of the toe portion.

20. The ski binding of claim 11, wherein the at least one resistance mechanism ski binding further includes two resistance mechanism cartridges, and wherein the at least two cables include a linkage end and a cartridge end, and wherein the linkage end is configured to be dropped through the resistance mechanism cartridge, and the cartridge end is configured to axially and rotationally chock within the cartridge.

21. The ski binding of claim 20, wherein the linkage end is smaller than the cartridge end of the at least two cables.

22. A ski binding comprising:

a toe portion compatible with a front portion of a ski boot;

a coupling system configured to releasably secure the ski boot to the toe portion, wherein the coupling system includes:

a heel attachment mechanism;

at least one cable coupled to the toe portion; and at least one resistance mechanism coupled to the at least one cable and the heel attachment mechanism, wherein the coupling between the at least one cable and the at least one resistance mechanism includes a 360 degree axial and rotational non-threaded chocking mechanism to prevent inadvertent adjustment.

23. The ski binding of claim 22, wherein the toe portion includes a lower surface, two side surfaces, and an upper surface.

24. The ski binding of claim 22, wherein the toe portion includes a linkage configured to releasably secure the at least one cable at the toe portion.

25. The ski binding of claim 22, wherein the toe portion includes at least two recesses for the at least one cable to extend through.

26. The ski binding of claim 22, wherein the toe portion is coupled to a ski.

27. The ski binding of claim 22, wherein the heel attachment mechanism further includes a heel throw and two rigid wires.

28. The ski binding of claim 22, wherein the ski binding further includes a heel plate configured to prevent a heel portion of the ski boot from dropping below a lower surface of the toe portion.

* * * * *